United States Patent [19]

Langer

[11] Patent Number: 4,979,562

[45] Date of Patent: Dec. 25, 1990

[54] FLOAT EQUIPMENT INCLUDING FLOAT COLLARS AND MODULAR PLUGS FOR WELL OPERATIONS

[75] Inventor: Friedrich H. Langer, Houston, Tex.

[73] Assignee: Weatherford U.S., Inc., Houston, Tex.

[21] Appl. No.: 261,385

[22] Filed: Oct. 21, 1988

[51] Int. Cl.[5] ..... E21B 17/14; E21B 33/14

[52] U.S. Cl. ..... 166/242; 166/156

[58] Field of Search ..... 166/242, 327, 328, 329; 166/325, 326, 156, 155, 154, 153; 175/318; 137/515, 515.5

[56] References Cited

U.S. PATENT DOCUMENTS

| | | | |
|---|---|---|---|
| 1,369,891 | 3/1921 | Halliburton . | |
| 1,872,855 | 3/1932 | Walker | 166/153 |
| 1,882,314 | 10/1932 | Burt | 166/328 |
| 2,075,882 | 4/1937 | Brantly | 166/21 |
| 2,104,270 | 1/1939 | Owsley | 166/1 |
| 2,162,261 | 6/1939 | Layne | 166/21 |
| 2,165,433 | 7/1939 | Wickersham | 166/1 |
| 2,169,568 | 8/1939 | Morrisett | 166/1 |
| 2,196,652 | 4/1940 | Baker . | |
| 2,196,657 | 4/1940 | Burt . | |
| 2,201,299 | 5/1940 | Owsley et al. | 166/1 |
| 2,263,566 | 11/1941 | Boynton . | |
| 2,320,670 | 6/1943 | Searamucci | 166/328 |
| 2,467,854 | 4/1949 | Ragan | 166/325 X |
| 2,627,314 | 2/1953 | Baker et al. | 166/1 |
| 2,630,179 | 3/1953 | Brown | 166/14 |
| 2,662,600 | 12/1953 | Baker et al. | 166/1 |
| 2,717,645 | 9/1955 | Schnitter | 166/156 |
| 2,740,480 | 4/1956 | Cox | 166/170 |
| 2,854,079 | 9/1958 | Schnitter | 166/70 |
| 3,006,415 | 10/1961 | Burns et al. | 166/156 |
| 3,062,296 | 11/1962 | Brown | 166/327 X |
| 3,105,378 | 10/1963 | Darling | 166/325 X |
| 3,159,219 | 12/1964 | Scott | 166/156 |
| 3,507,325 | 4/1970 | Scott | 166/5 |
| 3,545,543 | 12/1970 | Kemmerer et al. | 166/212 |
| 3,550,683 | 12/1970 | Comeaux | 166/156 |
| 3,581,817 | 6/1971 | Kemmerer | 166/208 |
| 3,768,556 | 10/1973 | Baker | 166/154 |
| 3,835,889 | 9/1974 | Hyde | 138/93 |
| 3,842,905 | 10/1974 | Morrisett et al. | 166/155 |
| 4,175,619 | 11/1979 | Davis | 166/291 |
| 4,190,111 | 2/1980 | Davis | 166/291 |
| 4,190,112 | 2/1980 | Davis | 166/291 |
| 4,246,968 | 1/1981 | Jessup et al. | 166/334 |
| 4,262,702 | 4/1981 | Streich | 138/89 |
| 4,378,838 | 4/1983 | Ogden et al. | 166/153 |
| 4,429,746 | 2/1984 | Allard | 166/291 |
| 4,442,894 | 4/1984 | Callihan | 166/156 |
| 4,491,178 | 1/1985 | Terrell et al. | 166/192 |
| 4,589,495 | 5/1986 | Langer et al. | 166/327 X |
| 4,606,406 | 8/1986 | Wood | 166/187 |
| 4,706,747 | 11/1987 | Schneider | 166/153 |
| 4,711,300 | 12/1987 | Wardlaw et al. | 166/153 |

OTHER PUBLICATIONS

Weatherford Float and Guide Equipment, Conventional and Specialized Float Equipment, 1985.

*Primary Examiner*—Hoang C. Dang

*Attorney, Agent, or Firm*—Guy McClung

[57] ABSTRACT

Float equipment for well operations including float collars and plugs for use therein. In one embodiment a plug has a plurality of modular members so that a plug of desired dimensions and materials can be custom assembled for a particular job. Such a plug may include a plurality of modular wipers and spacers connected together with a plug top and a plug bottom with adhesives or connection means or both. Not only can such connection means provide an antirotation effect between adjacent plug components, but also combinations of lugs and recesses can achieve this. Also a plug is taught which can have a cavity therein with pieces of material for enhancing a plug's drillability. A float collar is disclosed which in one embodiment has a seal plate which sealingly contacts an interior collar wall, which is configured to produce high friction between it and a correspondingly formed plug bottom for an enhanced antirotation effect, and which has gaps for permitting fluid trapped between the collar and plug to flow down into the collar's central bore. A plug is disclosed having a body, wiper means, and a cavity therein containing pieces of material for enhancing plug drillability. A plug is disclosed which has a body member and a cavity therein with pieces of material therein for enhancing the plug's drillability.

3 Claims, 6 Drawing Sheets

FIG. 5
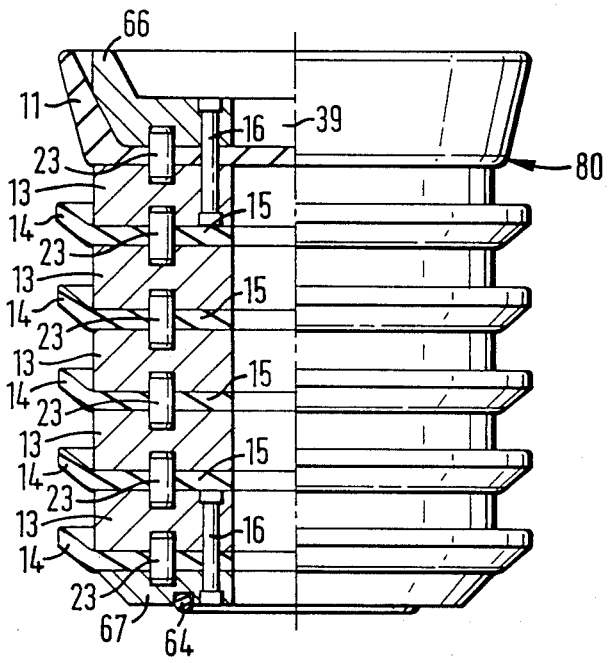
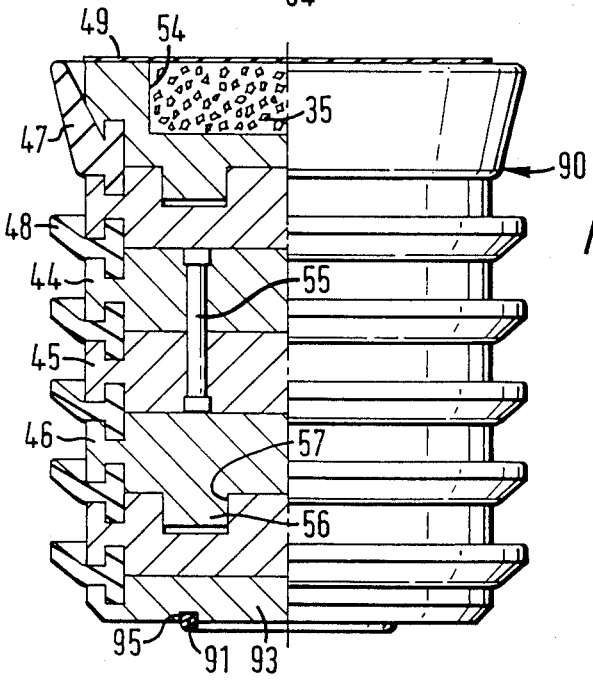
FIG. 6

FLOAT EQUIPMENT INCLUDING FLOAT COLLARS AND MODULAR PLUGS FOR WELL OPERATIONS

BACKGROUND OF THE INVENTION

1. Field of the invention

This invention is directed to plugs for use in well operations, and in certain embodiments is particularly directed to cementing and testing operations.

2. Description of the Prior Art

Cementation is one of the most critical processes in drilling and completing a well and it is an important part of the running of casing. Cementing is done at various points in the well and at various times while drilling both inside and outside of the casing.

The primary cementing can form a protective sheath around the casing, segregating producing formations to prevent migration of undesirable fluids. Secondary cementing takes place after the primary cementing and can be used to squeeze cement into the perforations in the casing or to seal off, isolate or repair parts of the well. Plug back cementing is used to place cement at desired points in the well or to shut off the bottom water or reduce the depth of the well.

Two of the apparatuses, pipe attachments, or "float equipment" routinely used in the cementing operations are the collar and the shoe. These are typically cement restrictions or shoulders which are attached to a pipe string as a part of the pipe string. The collar, for example a float collar, is inserted between the top and bottom of a casing string usually one or two joints above a float shoe which is attached to the bottom of a pipe string. Shoes and collars, among a number of things, help prevent the back flow of cement during the cementing operation. The collars and the shoes are usually equipped with a check valve to aid in the prevention of back flow of cement. The shoes and collars are typically an outer cylindrical housing or pipe and an inner cement tube communicating with and fixed to the inner surface of the cylindrical housing, with a fluid passage running the length of the cement tube. When there is a check valve, it is usually part of an inner housing in concentric spaced relationship with the outer housing so that the cement tube fills the space between the two housings and the inner housing forms part of the fluid passage.

In addition to the collars and shoes typical cementing operations employ one or more pump down plugs. Pump down wipe plugs can serve a variety of purposes: (1) to separate or serve as the interface between the cement slurry from the fluid it is displacing or the fluid which is being used to displace the cement to the desired level; (2) to wipe off the inner surface of the pipe string as it passes; (3) to help prevent back flow while the cement is setting up; and (4) as a sealing means for checking the integrity of casing strings with high hydrostatic pressure.

In practice the well operator makes up his pipe string so that the collar or shoe is lowered into the well to the desired level. When he decides to cement he may place a bottom pump down plug between the fluid already in the well and the wet cement. This bottom plug has a fluid passage through it which is sealed by a diaphragm or membrane. The cement is pumped into the well forcing the bottom plug down the well, displacing. the fluid in front of it, until it reaches the top of the cement tube of the shoe or collar or shoulder. This restriction stops the plug and increased pumping pressure breaks the diaphragm or membrane and the cement passes through the plug and through the fluid passage of the collar or shoe. After the desired amount of cement is pumped into the well a top pump down plug is inserted to act as the interface between the fluid used to force the cement to the desired level. Often the bottom plug is not used and only one plug as the interface between the cement and the fluid is used to force the cement to the desired level. The top plug is usually pumped until it comes in contact with the bottom plug if one is used or the top of the cement tube part of the shoe or collar. The cement is allowed to set or harden and the well operator then carries out whatever other operations he intends to do.

The prior art plugs are usually made of a pliable or rubbery material, such as plastic, wood or rubber, sometimes with hollow metal or plastic cores and they fit snugly in the pipe string.

Once the cement has set up and the well operator has carried out his desired operations he may decide to drill out the plug and/or plugs, collar or shoe and the cement. The plugs are typically made of drillable material, as are the cement tube and innerhousing of the collar and shoe and of course, the cement which was pumped into the well. The well operator lowers the drill string into the well until the drill bit contacts the plug and he begins to drill by rotating the drill bit, usually clockwise.

Stage cementing tools are used to protect formations or when an extremely long column of cement is required. A common practice is for the tool or tools to be positioned in the string as it is run. During the cementing process an operating tool called a "bomb" is dropped. The bomb contacts a projection in the tool and on application of pressure causes the tool to open and cement is pumped into the annulus. Upon completion of cement displacement an operating tool called a "closing plug" is dropped. The closing plug contacts a projection in the tool and on application of pressure causes the tool to close. On completion of cementing, the stage tool projections, bomb and closing plug are drilled out.

It is sometimes desirable to pressure test the string with the closing plug in place. When done, a hydrostatic pressure is applied on top of the closing plug resulting in substantial loading.

Often during drill out, problems are encountered because of the elastomeric nature of the material used in many plugs; i.e., drilling is made more difficult because a drill bit may seize or "grab" the material rather than drilling through it easily as it does through taut, hardened materials such as cement. Other problems with plugs are related to the fact that, although no two wells are identical, the available plugs are fairly standardized stock items which do not permit customization for a specific job. Customized plugs for each job would be prohibitively expensive. It is also expensive, however, to maintain an inventory of the variety of available standard plugs. For example, although a piece of casing may be nominally designated as "7 inch casing", inside diameters of such casing can vary significantly depending on the weight per foot of the casing; e.g., 7 inch casing of 20 pounds per foot can have an inside diameter of 6.456 inches and a wall thickness of 0.272 inches, while that of 38 pounds per foot will have an inside diameter of 5.920 inches and a wall thickness of 0.540 inches.

To solve problem of drilling materials like rubber, prior art methods have included the use of a burlap sack full of glass bottles thrown down the well onto the plug. Previous attempts to solve the problems related to the non-availability of customized plugs include maintaining a large inventory of various different standard plugs.

There has long been a need for an easily drillable plug for well operations. There has long been a need for a plug whose physical dimensions (length, width, diameter) and physical properties can be readily and quickly customized for a particular job. There has long been a need for a plug which has a reduced amount of elastomeric material, but which can effectively operate within the well. There is an unsatisfied demand for a plug which uses less elastomeric material. There has long been a need for a plug which provides an effective seal within a well. There has long been a need for a plug which provides an effective flow path for fluid between a plate and a plug or between two plugs so that there is no unwanted pressure build-up of fluid between these items.

SUMMARY OF THE PRESENT INVENTION

The present invention is directed to float equipment including float collars and plugs for well operations. One plug according to the present invention is made up of a plurality of identical and/or different modules so that a plug of desired dimensions and physical properties can be assembled. In one embodiment a plug according to this invention has a plurality of generally circular wipers which are spaced apart by generally circular spacers positioned between the wipers. Both the wipers and the spacers can be of the same or different configuration as needed. Separate items such as pins or bolts can hold the parts together or the wipers and spacers themselves may have devices formed integrally thereof or connected thereto for co-action to hold the parts together; e.g., in one embodiment the wipers may have integral protruding pins which are received in and held by corresponding recesses in the spacers. Top and bottom plates may be similarly connected to the plurality of wipers and spacers to form a desired plug. One or more cavities may be provided in the plug (in any of its component parts, e.g., wiper, spacer, bottom plate, top plate) to hold a hard material such as glass, or metal, ceramic, or cement to make it easier to drill the plug out. Sealing surfaces or seal devices (e.g. O-rings) may be provided on the plug's plates to effect better sealing of the plug with items in a well bore. An anti-rotation effect may be achieved by forming a plug plate from a high friction material which will prevent or inhibit rotation of the plug when the high friction material of the plug encounters a surface within the well bore. Also the plug surface can be configured to optimize this effect. Similarly, according to this invention a float collar can be provided which has a high friction surface for abutting a high friction surface on a plug and the high friction surface on the float collar (e.g., on a plate in the float collar) can be configured to optimize contact, sealing and the anti-rotative effect. According to this invention a float collar is disclosed which has an effective apparatus for sealing a collar top plate in the float collar. A plug and float collar are provided which have aspects for preventing the trapping of fluid.

In one embodiment of a plug according to this invention wipers can be used which do not extend completely across the plug's cross section. Such wipers can have extending ribs which facilitate their emplacement in recesses in intermediate spacers. In one embodiment of a plug according to this invention bolts may be used to connect together two or more components of the plug and, if desired, a single elongated bolt or pin may be used which extends through the majority of or all of the plug's components. Of course the available prior art antirotation means such as teeth and protrusions can be used in plugs according to this invention.

The present invention, therefore, recognizes, addresses, and satisfies the previously discussed long-felt needs and solves the problems encountered with prior art plugs, collars, and methods.

To one of skill in this art who has the benefits of this invention's teachings and disclosures, other and further objects and advantages , as well as others inherent therein, will be clear from the following description of presently-preferred embodiments, given for the purpose of disclosure, when taken in conjunction with the accompanying drawings and photographs. Although these descriptions are detailed to insure adequacy and aid understanding, this is not intended to prejudice that purpose of a patent which is to claim an invention no matter how others may later disguise it by variations in form or additions or further improvements. The claims at the end of this specification are intended as an aid toward this purpose.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiment thereof which is illustrated in the appended drawings, which drawings form a part of this specification, it is to be noted, however, that the appended drawings illustrate only a preferred embodiment of the invention and are therefore not to be considered limiting of its scope, for the invention may admit to other equally effective embodiments.

FIGS. 2–6 are side views, partially cut away, of plugs according to the present invention.

DESCRIPTION OF PRESENTLY-PREFERRED EMBODIMENTS

Figure 1:
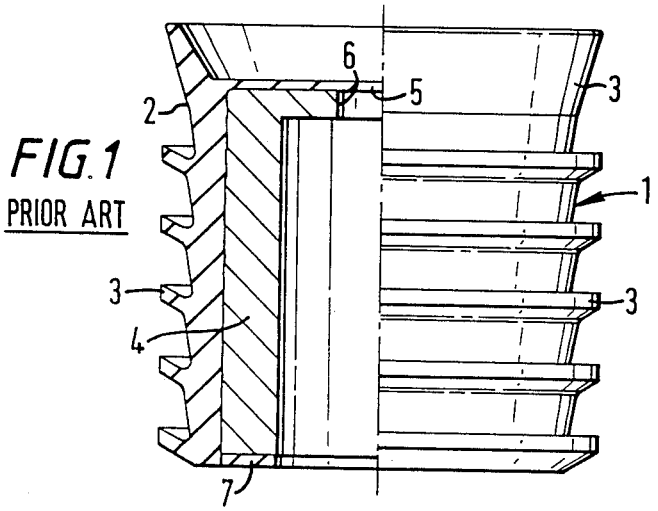
FIG. 1 PRIOR ART
FIG. 1 is a side view partially cut away of a prior art plug.

FIG. 1 discloses a typical prior art plug for well operations. A plug 1 has a wiper body 2 with a plurality of integral wiper lips 3, an internal body member 4 and a ruptureable membrane 5 which extends over a hole 6 in the body member 4. A bottom surface 7 provides sealing against a collar plate (not shown) or other items encountered in a well bore. The plug 1 is a typical bottom wiper plug. The body 2 is made from an elastomeric material such as rubber; the internal body member 4 is made from a relatively hard, strong material such as bakelite or metal (e.g., aluminum and, optimally, as little of this material is used as possible. This results in a reduction in the effectiveness of the bottom surface 7 as a seal since high pressure can push up on the portion of the surface 7 behind which there is no hard material to serve as a support.

Figure 3:
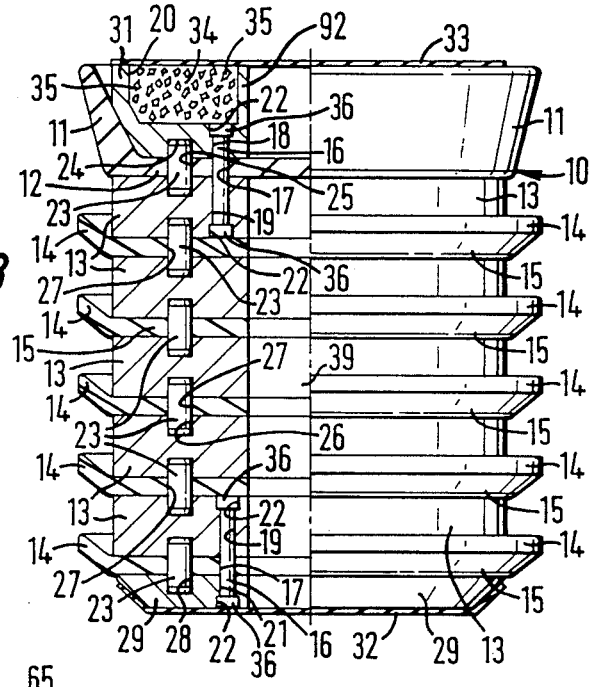

As shown in FIG. 3 a plug 10 according to the present invention is comprised of a plurality of interconnected parts including wipers 15, spacers 13, a wiper 12, a top 31 with its closure 33, and a bottom 29 with its closure 32. Various parts are connected together with a plurality of pins 23 and a plurality of pins 16 (two shown). A pin 16 extends from a hole 18 in the top 31, through a hole 17 in the wiper 12, and into a hole 19 in the spacer 13 which abuts the wiper 12. The pin 16 has threaded ends (not shown) and threaded nuts 36 engage the ends of the pin 16 to hold the pin 16 in place and to hold together the members (31, 12, 13) though which the pin 16 extends. The nuts 36 are received in recesses 22 in the top 31 and in the spacer 13. The pin 16 which extends through the wiper 12 also serves as an anti-rotation device to prevent the top 31, wiper 12, and spacer 13 from rotating with respect to each other. Another pin 16 extends from a hole 21 in the bottom 29, through a hole 37 in a wiper 14 and into a hole 19 in a spacer 13. The bottom 29 and spacer 13 have recesses 22 for receiving nuts 36 which are threadedly connected to the ends of the pin 16 which extends into the bottom 29. It is preferred that each adjacent pair of spacers be connected by a pin 16 and that these pins be offset when viewed from above so that a spacer between two spacers will have two pins therethrough, one extending into the spacer above and one into the spacer below, these two pins being offset from each other.

The bottom 29 has a bottom closure 32 and the top 31 has a top closure 33 which closures are either glued to the bottom or top respectively or formed integrally thereof. The bottom closures are formed of a material such as rubber which assists in sealing the plug against a member which it contacts. The top closure 33 covers a recess in the top 31 which forms a cavity 34 in which are many pieces of glass 35 for enhancing the drillability of the plug 10. The recess 20 extends generally circumferentially around the top 31. The wiper 12 has a wiping lip 11 extending outwardly from and sloping away from the wiper 12. A wiping lip 14 extends outwardly from and slopes away from each wiper 15. Pins 23 extend through each wiper 15. Pins 23 extend through each wiper 15 and 12 through holes 27 and hole 25 respectively. At the top of the plug 10 a pin 23 extends into a hole 24 and at the bottom a pin 23 extends into a hole 28 in the bottom 29. Pins 23 have a press fit in the members through which they extend and/or they are glued therein. Each pin 23 holds together the members into which it extends and also provides an anti-rotation function between those members. The ends of pins 23 are slightly chamfered or pointed to facilitate their insertion. The plug 10 is a bottom plug and has a bore 39 therethrough which, upon rupture of the closures 32, 33, allows fluids or cements to flow through the plug.

Figure 2:
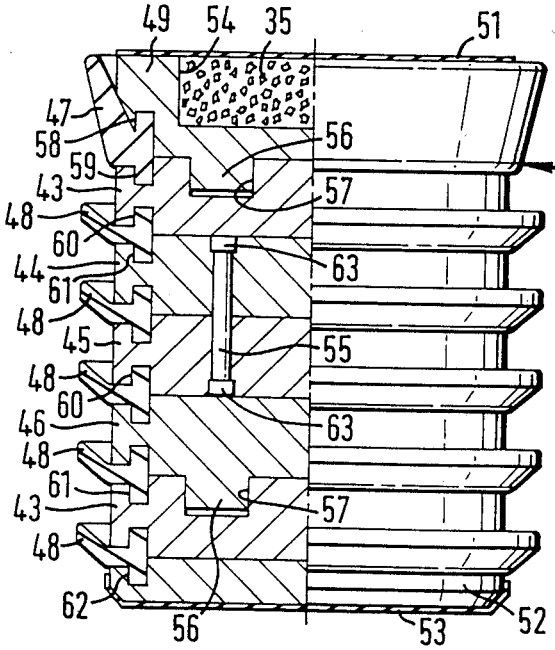

A plug 40 is shown in FIG. 2 according to this invention which is made up of a plurality of spacers 43, a top 49, a bottom 52 and a plurality of wipers 47, 48. The wiper 47 extends into and is held by a press fit in recesses 58 and 59 in the top 49 and spacer 43, respectively. The wipers 48 extend into and are held by a press fit in recesses 60, 61 in the spacers 43 and in recess 62 in the bottom 52. Pins 55 (similar to the pins 16 of FIG. 1) extend between two spacers 43 to hold them together. Nuts 63 can be used as the nuts 36 of FIG. 1. Antirotation lugs 56 extend from a spacer 46 into a recess 57 in an adjacent spacer 43. A bottom closure 53 is adhered to the bottom 52 for providing a sealing element and a top closure 51 is adhered to the top 49 for providing a sealing element. Glass pieces 35 for enhancing the drillability of the plug 40 are contained in a cavity 54 in the top 49. Of course such a cavity with material therein can be provided in plugs according to this invention other than those shown in FIGS. 2–6. For example a plug according to this invention could be made like the plug of FIG. 1 but with a cavity therein containing pieces of material for enhancing the plug's drillability. Furthermore, plugs according to this invention can include a plug (useful for things other than wiping) which have a body member and a cavity therein containing pieces of material for enhancing the plugs's drillability. Also, although plugs are shown with wiper members it is within the scope of this invention to provide a plug without wipers yet which has either a cavity for holding material to enhance drillability and/or component modules (top, bottom and/or spacers) for producing a modular plug of desired configuration.

Figure 4:
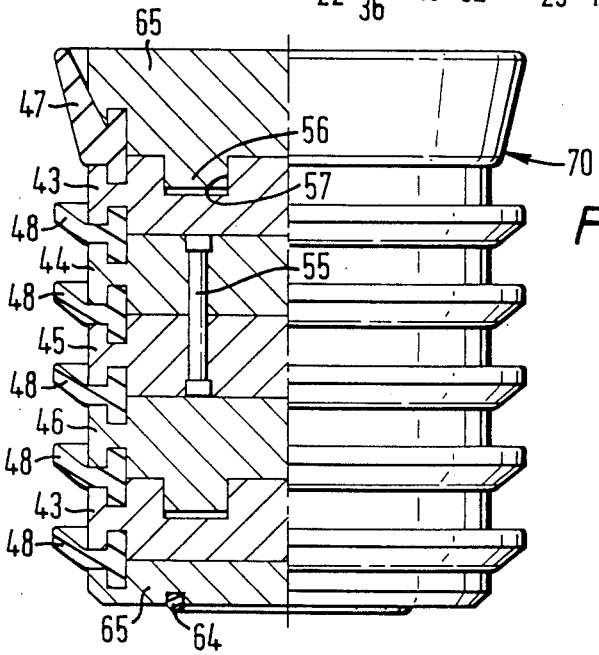

With respect to items 47, 48, 55, 56, and 57, a plug 70 is shown in FIG. 4 is like the plug 40 of FIG. 2. But the plug 70 has no cavity with glass pieces and it does not have a top or bottom closure for providing a sealing element but as a sealing O-ring 64 disposed in a bottom 65 of the plug 70. The O-ring 64 can be a separate O-ring or it can be an integral part of the bottom closure such as the closure 32 (FIG. 2). Again, as with the other plugs, wipers can have a press fit in spacers, top, and bottom and/or they can be glued in to hold the plug together.

With respect to items 11, 13, 14, 15, 16, 23, 39, 63, and 64, a plug 80 shown in FIG. 5 is like the previously described plugs with these items. The plug 80 also has a top 66 and a bottom 67.

A plug 90 shown in FIG. 6 is like the plug 40 shown in FIG. 2 but for the use of an O-ring 91 disposed in a recess 92 in a bottom 93 of the plug 90. The seal 91 can seal against a closure on an adjacent plug or against an upstanding rib such as a rib 95 on the plug 10 of FIG. 3.

Although cavities 34 and 54 are shown in plugs 10 and 40, respectively, as being of specific dimensions and being in specific locations; but it is within the scope of this invention to have cavities of any desired dimensions and located anywhere in the top, wipers, spacers, or bottom. Also, it is within the scope of this invention to vary the number of wipers and spacers as desired and it is also possible to have one or more spacers such as the spacers 13 adjacent each other and one or more wipers 15 adjacent each other, each of these types of elements in any combination to achieve a desired customized plug. It is within the scope of this invention to make different wipers, spacers or other components in the same plug out of different materials; e.g. (but not limited to) rubber, elastomers, harder plastics, soft metals, and/or cement based materials for spacers. It is also within the scope of this invention to make different wipers and spacers in the same plug of different dimensions including different thicknesses.

Various plugs according to this invention can be made so that the amount of rubber or other similar material used is minimized. Rubber and similar materials sometimes cause problems in drilling, e.g., they can "smear" or pull, reducing a drill's effectiveness since they are not as taut or hard as relatively easily drilled materials. In the plugs shown in FIGS. 2, 4, and 6 the wipers 47, 48 are made of rubber or similar material so that desired wiping and sealing effects can be achieved; but the tops, spacers, bottoms, pins and bolts of these plugs can be made from harder materials such as plastic, soft metal, or cement based materials which are easier to drill than rubber. Thus reducing the amount of rubber (or similar material) in a plug provides a plug which is easier to drill.

FIGS. 7–15 show plugs and float collars according to the present invention. It is common practice in the course of drilling a well to insert strings of casing of diminishing diametric extent into the well bore as drilling of the well progresses. This is accomplished by telescopically engaging the next string of casing of reduced diameter into the preceding larger string of casing, lowering it into the well through the preceding string or strings of casing by means of a setting tool at the lower end of a string of drill pipe, so that it depends into the well bore below the lower terminal end of the preceding string of casing, and then suspending it from the lower end of said preceding string of casing by means of a casing hanger, which hanger is engaged at the upper end of the string of new casing and which is actuated into gripping engagement with the said preceding string of casing by means of the setting tool. After the new casing is suspended in the well in the manner set forth above, the drill pipe and setting tool are pulled or removed from the well.

It is also common practice, after a new string of casing is suspended in a well in this manner, to cement it in fixed position in the well by introducing a slurry of cement into the annulus occurring between the well bore and the exterior of the new casing. This cementing operation is accomplished by providing a float collar in the new string of casing at a desired position intermediate its ends and then running a cementing tool, on the lower end of a string of drill pipe, into the new casing and introducing the cement into the casing under pressure and so that it flows downwardly through the float collar and the casing and into the well bore about the said casing.

A typical float collar has a tubular body interposed in the string of casing to be set and can be provided with a check valve mechanism adapted to prevent the upward flow of fluid. The float collar is intended to prevent the cement introduced into the well from flowing back up through the casing when the pressure above the float collar is reduced and/or when the cementing tool and drill pipe carrying it are removed or withdrawn from the well. The valve mechanism is mounted in the body of the ordinary float collar in a core of drillable material, such as cement, and so that when the cementing operation is completed, the new string of casing can be opened by drilling through the float collar and the cement occurring in the casing below the collar.

Figure 7:
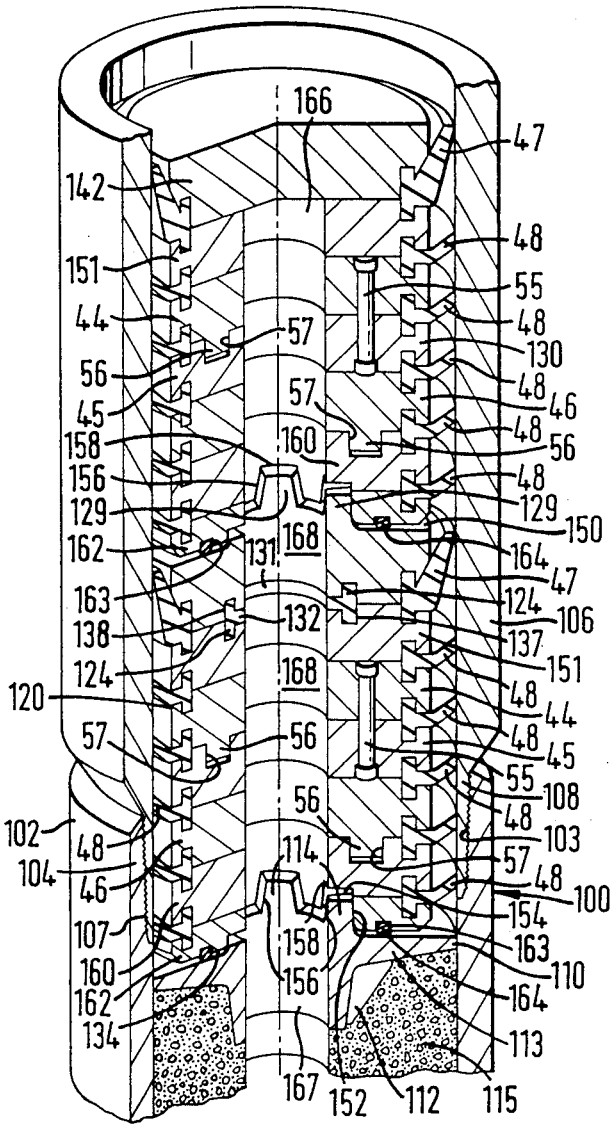
FIG. 7 is a perspective view in partial cross-section of a float collar with plugs according to the present invention.

A float collar 100 as shown in FIG. 7 has an elongated tubular body 102 with an upper end 104 that has internal threads 103 for threadedly mating with threads 107 of a lower end 108 of a casing 106. A seal plate 110 having an inner body 112, a plate member 113, and a plurality of upstanding lugs 114 is sealingly and firmly disposed across the float collar 100. The seal plate 110 has an internal bore or flow channel 167. A desired amount of concrete 115 is emplaced beneath the seal plate 110. The plate member 113 extends to abut and sealingly contact the inner surface of the tubular body 102 to effect a fluid tight seal.

As shown in FIG. 7 two plugs have moved down through the casing above the float collar 100. A bottom plug 120 similar to the plugs 40 and 70 described previously (but not identical) has moved down to engage and contact the seal plate 110. Items of the plug 120 which are like those items in the plugs 40 and 70 bear the same identifying numerals. A spacer 160 adjacent a bottom 162 of the plug 120 has slight recesses 158 for receiving, contacting, and holding the tops of the lugs 114 of the seal plate 110. The bottom 162 has recesses 156 for receiving, contacting, and holding the main portion of the lugs 114. The combination of the lugs 114 and recesses 156, 158 serve to hold the plug to the seal plate and to prevent rotation there between. The recesses 156 and 158 are disposed and configured so that there are small gaps 154 between the top of the lugs 114 and the bottoms of the recesses 158 and small gaps 152 between the main portion of the lugs 114 and the sides of the recesses 156, 158 so that any fluid caught in an area 134, rather than being trapped therein and preventing effective plug-seal contact and engagement, has a relief flow path out through the gaps 152, thence to the gaps 154 which are in fluid communication with the gaps 152, and thence into the bore 167 with which the gaps 152 are in fluid communication. An O-ring seal 164 is disposed in a recess 163 in the bottom 162 of the plug 120. The O-ring seal 164 sealingly abuts the top of the seal plate 110.

A ruptureable diaphragm 132 with a rib 124 is disposed in recesses 138 and 137 in a top 150 and a spacer 151 of the plug 120 respectively. The diaphragm 132 as shown has been ruptured so that the area above it is in fluid communication with a bore 168 of the plug 120 via a bore 131 in the diaphragm formed by the rupturing of the diaphragm. A plurality of lugs 129 extend upwardly from the top 150 (lugs similar in structure and function to the lugs 114). The parts of the plugs described herein are generally configured so that they can easily be correctly combined and assembled in the field in a "foolproof" manner. A gap can be provided between lugs 56 and bottom of recesses 57 for tolerance in assembly.

A plug 130 as shown in FIG. 7 has moved to contact and engage the plug 120. Items of the plug 130 which are like those items in the plug 120 bear the same identifying numerals. A top 142 of the plug 130 extends across and closes off a bore 166 through the plug 130.

Figure 8:
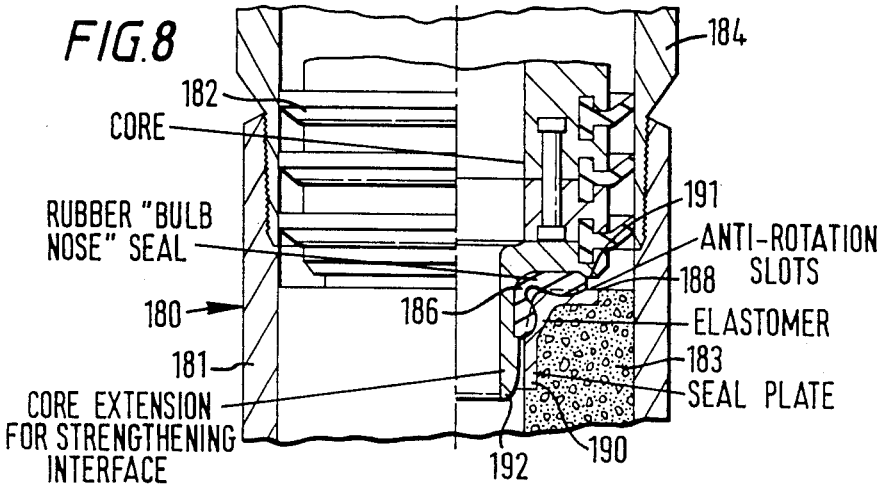
FIGS. 8 is a side view in cross-section of a float collar of which applicant is aware.

A float collar 180 as shown in FIG. 8 includes an elongate tubular body 181 in which is secured a seal plate 190 over concrete 183. The seal plate 190 has antirotation slots 188 for receiving a rubber bulb nose seal 186 of a plug 182 disposed in a casing 184 and the float collar 180. A bottom 191 of the plug 182 has a strengthening extension 192. Applicant is aware of the bulb nose seal concept, the antirotation slots 188 and the extension 192 but these are not ideas or inventions of this applicant. The bulb nose seal concept is envisioned as working by volume extension into the slots provided.

Figure 9:
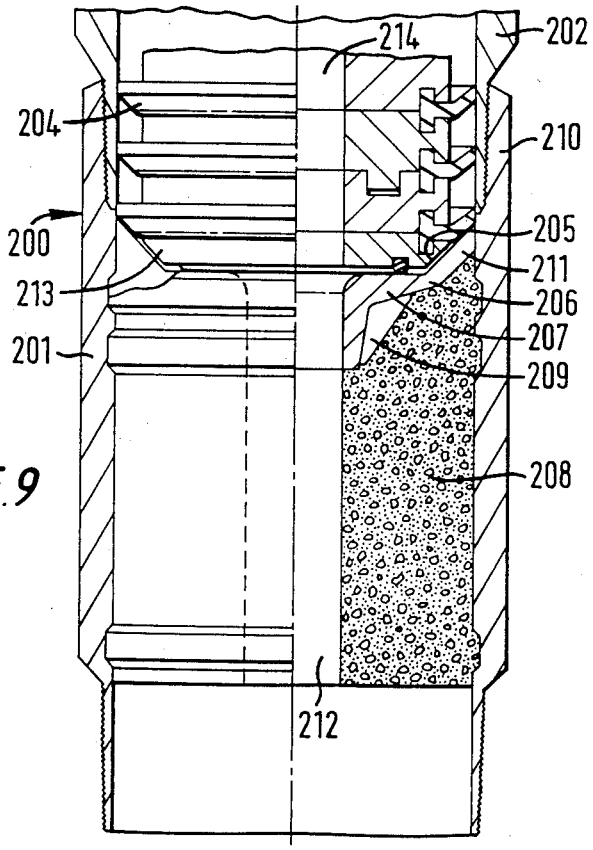
FIGS. 9, 10, 11 are side views, in cross section, of float collars according to this invention with plugs therein according to this invention.

A float collar 200 as shown in FIG. 9 has an elongate tubular body 201 and a seal plate 206 above concrete 208. A descending rib 209 and an upwardly-outwardly extending arm 211 which abuts and sealingly contacts the interior surface of the body 201. The plug 204 is similar to the previously described plugs. It has a bottom 213 with a side ridge 205 for contacting the arm 211. When the ridge 205 and the arm 211 are made of a high friction material such as brake band materials or a soft metal (e.g. aluminum), the contact of these two members inhibits slippage of the plug against the seal plate during drilling and also can enhance the sealing effect. A central bore 212 through the float collar 200 is in fluid communication with a central bore 214 of the plug 204.

Figure 10:
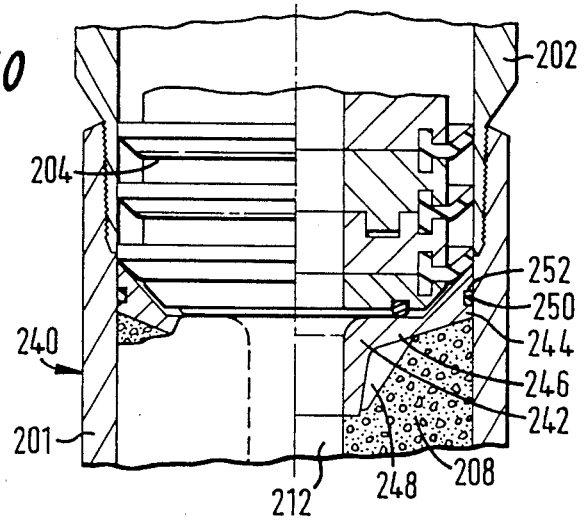

A float collar 240 shown in FIG. 10 is like the collar 200 shown in FIG. 9 and similar items bear the same identifying numerals. A seal plate 246 of the collar 240 has a descending rib 248, a main body 242 and an upwardly-outwardly extending arm 244. An O-ring 250 is disposed in a recess 252 in the arm 244 for enhancing the sealing contact of the arm 244 with the interior of the elongate tubular body 201 of the float collar 240.

Figure 11:
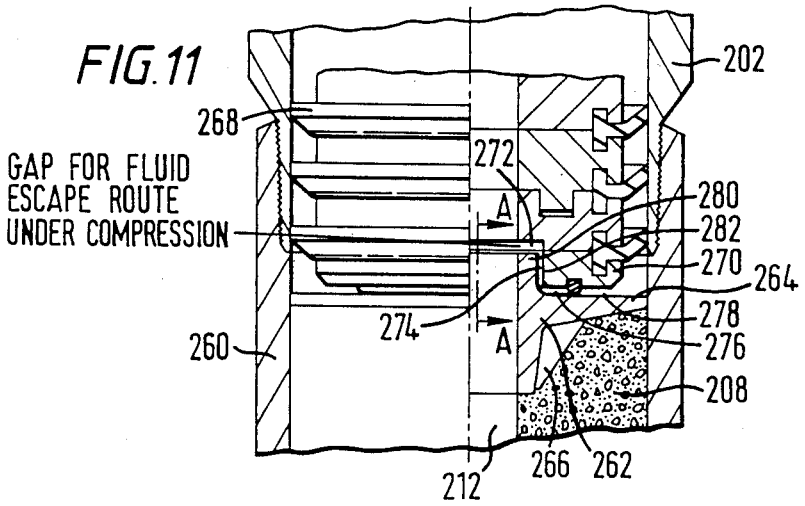

A float collar 260 shown in FIG. 11 has a seal plate 262 above concrete 208 and is shown with a plug 268 above the seal plate 262. The seal plate 262 has a downwardly descending rib 266, an outwardly extending arm 264 and a plurality of upwardly extending lugs 280 (one shown) which extends into recesses 282 (one shown) in a bottom 270 of the plug 268. Fluid in areas 276, 278 between the plug 268 and the seal plate 262 can flow therefrom through gaps 274 and 272 into a central bore 212 of the collar 260. The reception and holding of the lugs 280 in the recesses 282 provides an antirotation function between plug and collar.

Figure 12:
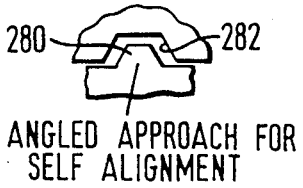
FIG. 12 is a side view in cross section along line A—A of FIG. 11.

FIG. 12 illustrates a configuration of the lug 280 and the recess 282 which are known to this applicant but not part of his invention. This configuration provides an easily engageable lug and recess for it.

In conclusion, therefore, it is seen that the present invention and the embodiments disclosed herein are well adapted to carry out the objectives and obtain the ends set forth at the outset as well as others inherent therein. It is intended that the appended claims be understood as referring to all equivalent combinations of the recited combinations.

I claim:

1. A float collar for use in well operations, the collar comprising an elongated hollow tubular body, a seal plate disposed across the hollow tubular body, the seal plate having an integral outwardly extending arm member sealingly contacting an inner surface of the hollow tubular body, the seal plate having a bore for fluid flow therethrough, an amount of hardened cement disposed beneath and in contact with the seal plate, the cement having a bore in fluid communication with the bore of the seal plate permitting fluid flow through the collar, and a recess provided in the outwardly extending arm member for receiving and holding a sealing O-ring for sealingly abutting the inner surface of the hollow tubular body, portions of the arm member adjacent the recess sealingly contacting the inner surface of the tubular body.

2. A float collar for use in well operations, for fixed interposition between two hollow tubular members in a string of such member, the collar comprising an elongated hollow tubular body, having a tubular body bore for the flow of fluid therethrough, a seal plate sealingly fixed across the hollow tubular body, the seal plate having an integral outwardly extending arm member sealingly contacting an inner surface of the hollow tubular body, the seal plate having a seal plate bore for fluid flow therethrough, and the integral outwardly extending arm member having a recess for receiving and holding a sealing O-ring for sealingly abutting the inner surface of the hollow tubular body, portions of the arm member adjacent the recess sealingly contacting the inner surface of the hollow tubular body.

3. A float collar for use in well operations, the collar comprising an elongated hollow tubular body, a seal plate disposed across the hollow tubular body, the seal plate having an integral outwardly extending arm member sealingly contacting an inner surface of the hollow tubular body, the seal plate having a bore for fluid flow therethrough, an amount of hardened cement disposed beneath and in contact with the seal plate, the cement having a bore in fluid communication with the bore of the seal plate permitting fluid flow through the collar, at least one upstanding lug on the seal plate for reception into at least one corresponding recess on a device disposed above the collar, the at least one upstanding lug configured so that the at least one corresponding recess is not completely closed off to the flow of fluid therethrough upon contact of the collar and the device, thereby permitting fluid trapped between the collar and the device to flow from the at least on corresponding recess into the bore of the seal plate and thence down and out of the collar, a high friction surface on the seal plate for contacting a corresponding surface on other apparatus inserted into the collar for providing an antirotation effect between the collar and the corresponding surface, and a recess in the outwardly extending arm member for receiving and holding a sealing O-ring for sealingly abutting the inner surface of the hollow tubular body, portions of the arm member adjacent the recess sealingly contacting the inner surface of the tubular body.

* * * * *